US005912605A

United States Patent [19]

Eberts

[11] Patent Number: 5,912,605

[45] Date of Patent: Jun. 15, 1999

[54] CIRCUIT BREAKER WITH AUTOMATIC CATCH TO PREVENT REBOUND OF BLOW OPEN CONTACT ARM

[75] Inventor: William George Eberts, Pittsburgh, Pa.

[73] Assignee: Eaton Corporation, Cleveland, Ohio

[21] Appl. No.: 08/975,474

[22] Filed: Nov. 20, 1997

[51] Int. Cl.[6] ..... H01H 75/00

[52] U.S. Cl. ..... 335/16; 335/195; 218/22

[58] Field of Search ..... 335/16, 147, 195; 218/22, 30, 31, 32, 33

[56] References Cited

U.S. PATENT DOCUMENTS

| | | | |
|---|---|---|---|
| 4,733,211 | 3/1988 | Castonguay et al. | 335/192 |
| 4,887,057 | 12/1989 | Gula et al. . | |
| 5,341,191 | 8/1994 | Crookston et al. . | |
| 5,363,076 | 11/1994 | Miller et al. | 335/16 |

*Primary Examiner*—Lincoln Donovan

*Attorney, Agent, or Firm*—Martin J. Moran

[57] ABSTRACT

The outside poles of a three pole circuit breaker are each provided with a blow open latch which includes a latch hook having an open slot forming jaws pivotally mounted on the contact arm. A torsion spring biases the jaws to a cocked position in which they are aligned for engagement with a fixed stop member toward which the contact arm rotates as it blows open in response to the magnetic repulsion forces generated by a short circuit. As the jaws engage the stop member, the latch hook is rotated to mechanically latch the latch hook on the stop member thereby preventing rebound and reclosing of the contacts. A leaf spring mounted on the crossbar holds the latch hook in mechanical engagement with the stop member. As the circuit breaker responds to the overcurrent condition and rotates the crossbar, the leaf spring disengages from the latch hook so that the torsion spring can rotate the latch hook back to the cocked position for disengagement from the stop member upon reclosing of the circuit breaker.

15 Claims, 6 Drawing Sheets

CIRCUIT BREAKER WITH AUTOMATIC CATCH TO PREVENT REBOUND OF BLOW OPEN CONTACT ARM

BACKGROUND OF THE INVENTION

1. Field of the Invention

The invention relates to circuit breakers having contact arms which are rapidly blown open in response to a short circuit before the spring driven operating mechanism can respond to the fault. More particularly, it relates to a catch mechanism which latches the contact arm in the blow open position and automatically releases as the operating mechanism responds to the overcurrent condition.

2. Background Information

Circuit breakers have sets of separable contacts which include a fixed contact and a movable contact mounted on a movable contact arm. The movable contact arm is rotated by an operating mechanism between a closed position in which the movable contact engages the fixed contact, and an open position in which the contacts are separated to interrupt current flow. Typically, the operating mechanism is spring powered to rapidly open the contacts in response to an overload condition.

The response of the typical spring driven operating mechanism is relatively slow. It is known to provide such circuit breakers with a blow open feature which utilizes the strong magnetic fields generated by very large overcurrent conditions such as accompany a short circuit to quickly open the contacts faster than the response time of the operating mechanism. Typically, in such circuit breakers with a blow open feature, the fixed conductor to which the fixed contact is secured, is positioned adjacent the movable contact arm with the contact closed to carry current in a direction opposite to the current through the movable contact arm. This generates magnetic repulsion forces tending to separate the contacts. Under normal current conditions and moderate overcurrent conditions, the contacts are held in a closed position by contact springs. However, the repulsion forces generated by a short circuit current are so high that they overcome the contact spring forces and rapidly blow the contacts open.

An example of a circuit breaker incorporating a blow open feature is found in U.S. Pat. No. 5,341,191. In this circuit breaker, the movable contact arm is mounted by a two-part pivot assembly. The pivot assembly includes a main carrier which is pivotally rotated by the operating mechanism to open and close the contacts. The movable contact arm is mounted on a second carrier which is pivotally mounted on the first carrier. Normally, the operating mechanism rotates the main carrier which carries with it the secondary carrier and the main contact arm to open and close the separable contacts. In response to a short circuit current, the secondary carrier is rotated relative to the main carrier in response to the very high magnetic repulsion forces generated by the fault current. The current required for the contact arm to blow open is determined by a spring loaded cam assembly which includes cam surfaces on the secondary carrier and spring biased cam followers mounted on the main carrier.

While the blow open circuit breaker of U.S. Pat. No. 5,341,191 has been effective in responding rapidly to short circuit currents, the very large repulsion forces accompanying a short circuit generate a great deal of kinetic energy in the moveable contact arm which, when it encounters stops at the blow open position rebounds towards the fixed contact. This can result in restriking of an arc between the contacts necessitating a second extinguishing of an arc which imposes heavy wear on the contacts. One solution has been to absorb the kinetic energy of the moveable contact arm by mounting dead rubber stops in the cover which the arm strikes, but often the energy cannot be absorbed in this manner.

U.S. patent application Ser. No. 08/806,030, filed on Sep. 3, 1996, addresses this problem by providing a latch which latches the contact arm in the blow open position. In a preferred embodiment of the invention this latch takes the form of a cantilevered leaf spring forming a detent which is engaged by the secondary carrier as the moveable contact arm blows open. When the operating mechanism finally responds to the short circuit and rotates the main carrier to the open position, the secondary carrier is disengaged from the leaf spring. In a second embodiment of the invention described in this patent application, there is a cam and cam follower arrangement between the main carrier and the secondary carrier. The latch means is a notch in the cam which is engaged by a spring biased cam follower to latch the moveable contact arm in the blow open position. In this embodiment, the operating mechanism must overcome the spring bias of the cam follower to disengage the latch as the operating mechanism responds to the short circuit current. The latch mechanism described in U.S. patent application Ser. No. 08/806,030 is not adaptable to all circuit breakers with blow open contact arms.

There is a need therefore for an improved latch for latching a moveable contact arm of a circuit breaker in the blow open position.

There is a further need for a circuit breaker incorporating such an improved latch.

There is an additional need for such a circuit breaker in which the latch provides a positive mechanical latching of the contact arm in the blow open position but which is automatically released as the operating mechanism responds to the short circuit.

There is a still further need for such a circuit breaker in which the mechanism latch does not interfere with normal operation of the circuit breaker when the moveable contact arm is not blown open but is rotated to interrupt current by the operating mechanism.

SUMMARY OF THE INVENTION

These needs and others are satisfied by the invention which is directed to a latch for releasably latching the moveable contact arm of a circuit breaker in the blow open position to prevent rebound. This latch includes a latch hook pivotally mounted on the contact arm and having an open slot forming jaws. A fixed stop member is provided in this circuit breaker at a position towards which the contact arm rotates to the blow open position. Means are provided which rotationally position the latch hook to a cocked position with the jaws aligned for engagement with the stop member. The latch hook rotates from the cocked position to a latched position in which the jaws engage the stop member as the contact arm reaches the blow open position to thereby prevent rebound of the contact arm from the blow open position. Holding means retain the latch hook in the latched position until the circuit breaker operating mechanism responds to the overcurrent condition causing the blow open. Preferably, the means rotationally positioning the latch hook to the cocked position comprises biasing means and most preferably this biasing means is a torsion spring having one arm which bears against the moveable contact arm and a second arm which engages the latch. Also preferably, the holding means comprises a latch member and means positioning the latch member to engage and rotate the latch hook to the latched position as the contact arm rotates to the blow open position. The latch member is repositioned to disengage from the latch hook as the circuit breaker operating mechanism responds to the overcurrent and rotates the moveable contact support assembly for the contact arm to the open position. Most preferably, the latch member is a leaf spring mounted on a contact arm carrier on which the contact arm is pivotally mounted. The contact arm carrier in turn is pivotally mounted for rotation by the operating mechanism.

The invention includes a circuit breaker incorporating the novel latch.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
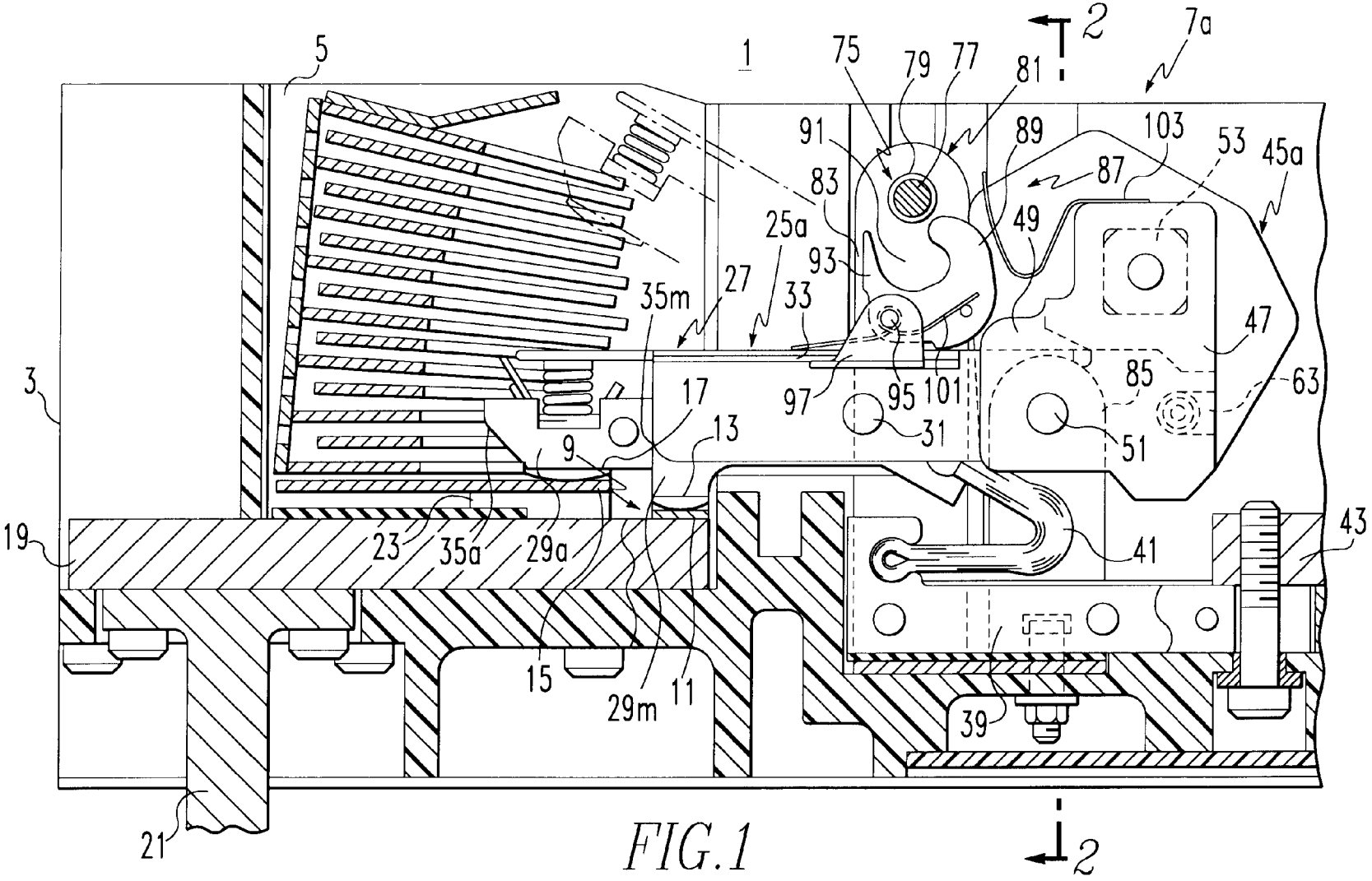
FIG. 1 is a partial sectional view through an outer pole of a circuit breaker incorporating the invention.
Figure 2:
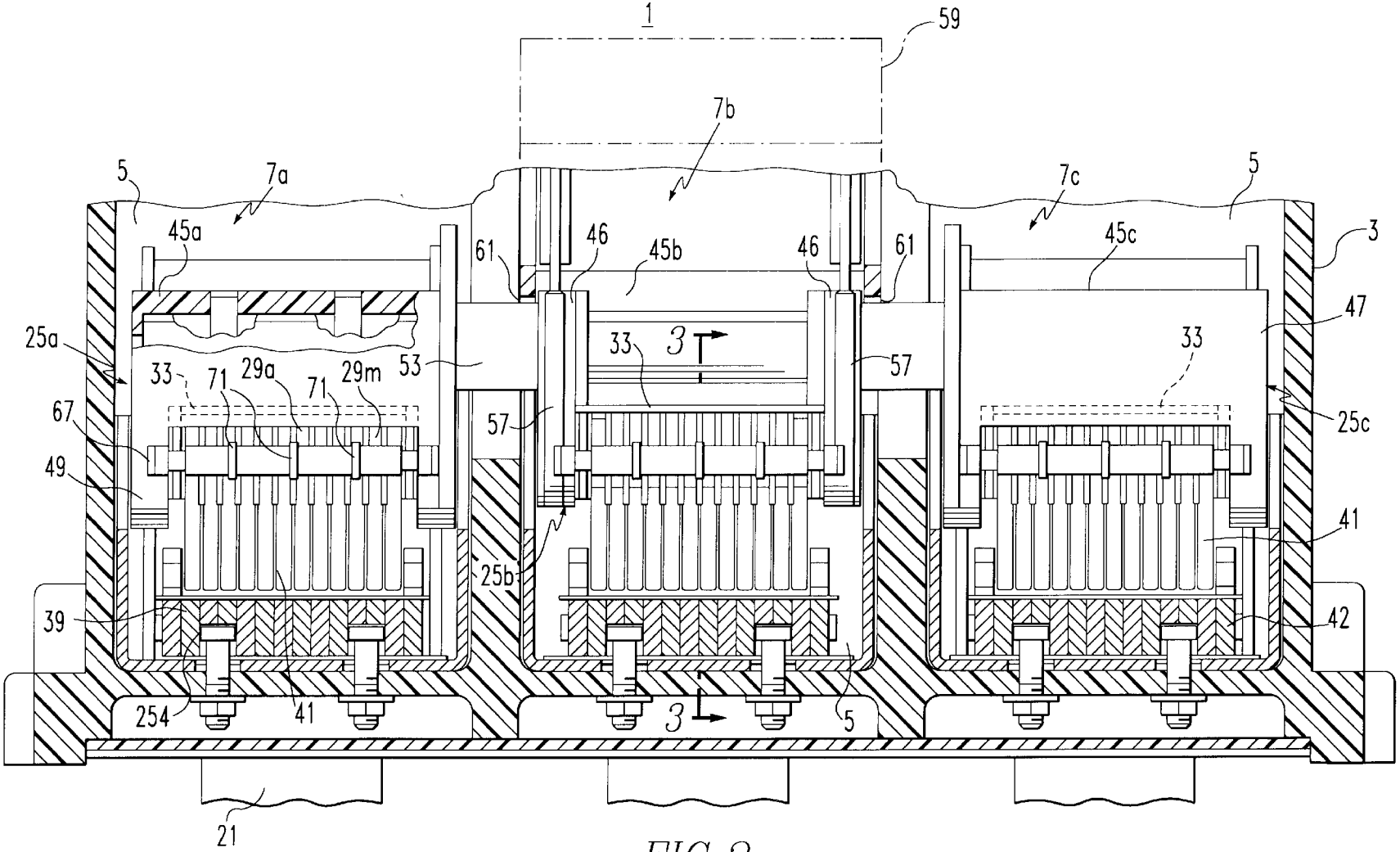
FIG. 2 is a cross-sectional view taken along the line 2—2 in FIG. 1.
Figure 3:
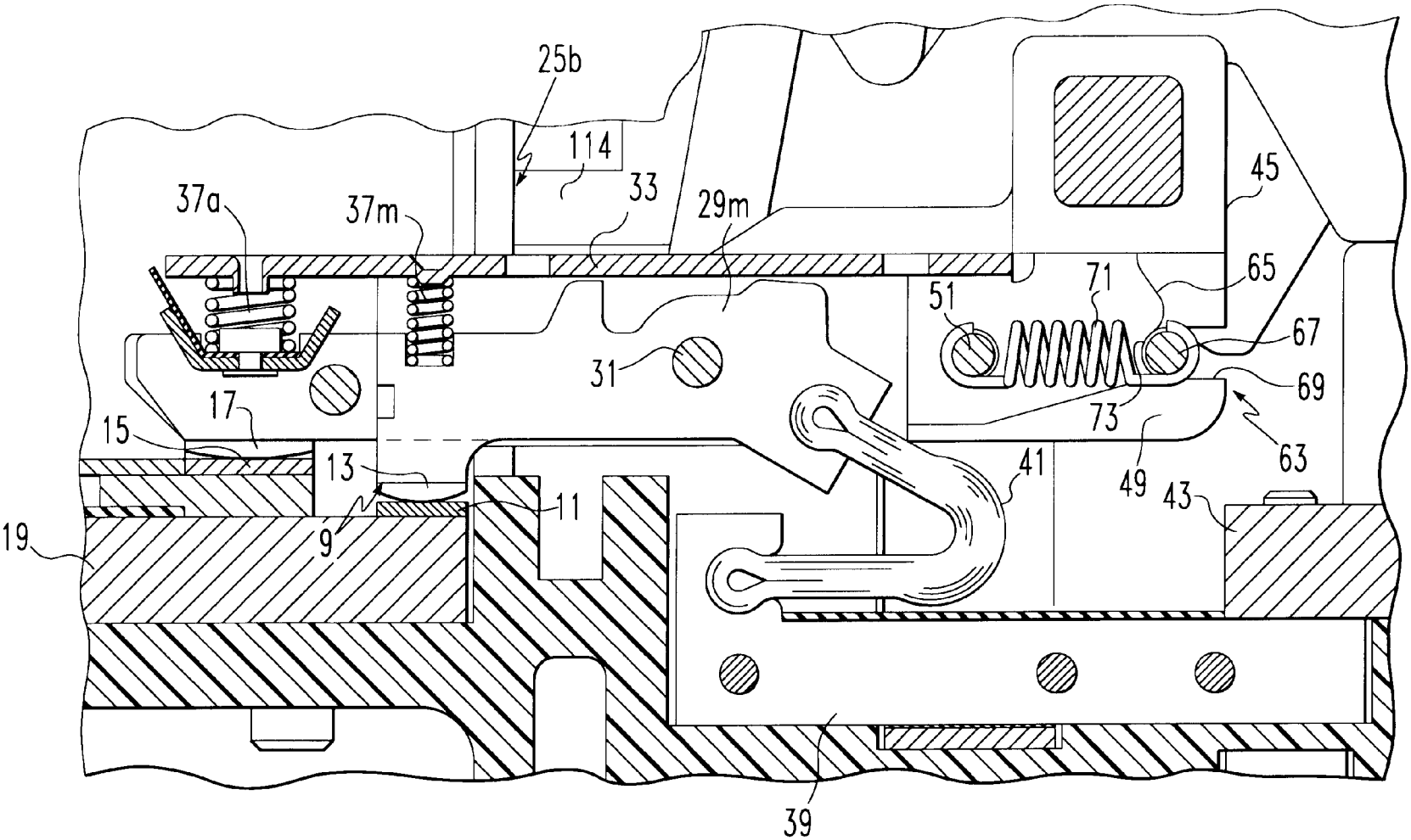
FIG. 3 is a partial sectional view taken along the lines 3—3 in FIG. 2.

The invention will be described as applied to a molded case circuit breaker of the type described in U.S. Pat. No. 4,887,057 which is hereby incorporated by reference. Referring to FIGS. 1–3, the circuit breaker 1 includes a molded housing 3 forming compartments 5 for each of the poles 7 of the circuit breaker. The exemplary circuit breaker has three poles $\mathbf{7}_a$, $\mathbf{7}_b$ and $\mathbf{7}_c$ mounted side by side in the housing 3.

Each pole 7 has a set of separable contacts 9 which includes a fixed main contact 11 and moveable main contact 13 as well as fixed and moveable arcing contacts 15 and 17, respectively. The fixed main contact is affixed to a line side conductor 19 which in turn is connected to the line stab 21 projecting through the bottom of the housing 3 for connection to a line conductor in a panel board (not shown). The fixed arcing contact 15 is affixed to a spacer 23 mounted on the line side conductor 19. The moveable main contact 13 and moveable arcing contact 17 are carried by a moveable contact support assembly 25. This assembly 25 includes a contact arm 27.

The contact arm 27 includes a number of laminations 29*m* for the main contact and 29*a* for the arcing contact which are all pivotally mounted by a pin 31 in a downwardly facing U-shaped bracket 33. The moveable main contact 13 is affixed adjacent a first, free end 35*m* of the laminations $\mathbf{29}_m$ while the moveable arcing contact 17 is similarly affixed to the end 35*a* of the laminations 29*a*. As best seen in FIG. 3, the moveable main contact 13 is biased by a main contact spring 37*m* about the pivot pin 31 against the fixed main contact 11. Similarly, the arcing contact spring 37*a* applies contact pressure to the arcing contacts 15 and 17. Each of the laminations 29 is electrically connected to a stationary conductor lamination 39 by a flexible shunt 41. The stationary conductor laminations 39 are bolted to a load side conductor 43 which in turn is secured to a load side stab (not shown) which projects through the bottom of the housing in a manner similar to that of the line stab 21.

The moveable contact support assembly 25 further includes a carrier 45. The carriers 45*a* and 45*c* for the contact support assemblies 25*a*, 25*c* of the outer poles each have a body 47 molded of an electrically insulative resin. Integrally molded with the body 47 are a pair of spaced apart downwardly and forwardly extending flanges 49, between which the contact arm 27 is pivotally connected by a pin 51 extending through the legs of the U-shaped bracket 33. A cross-bar 53, which in the exemplary embodiment is square in cross-section, extends through and rigidly connects the carriers of all of the poles.

Figure 4:
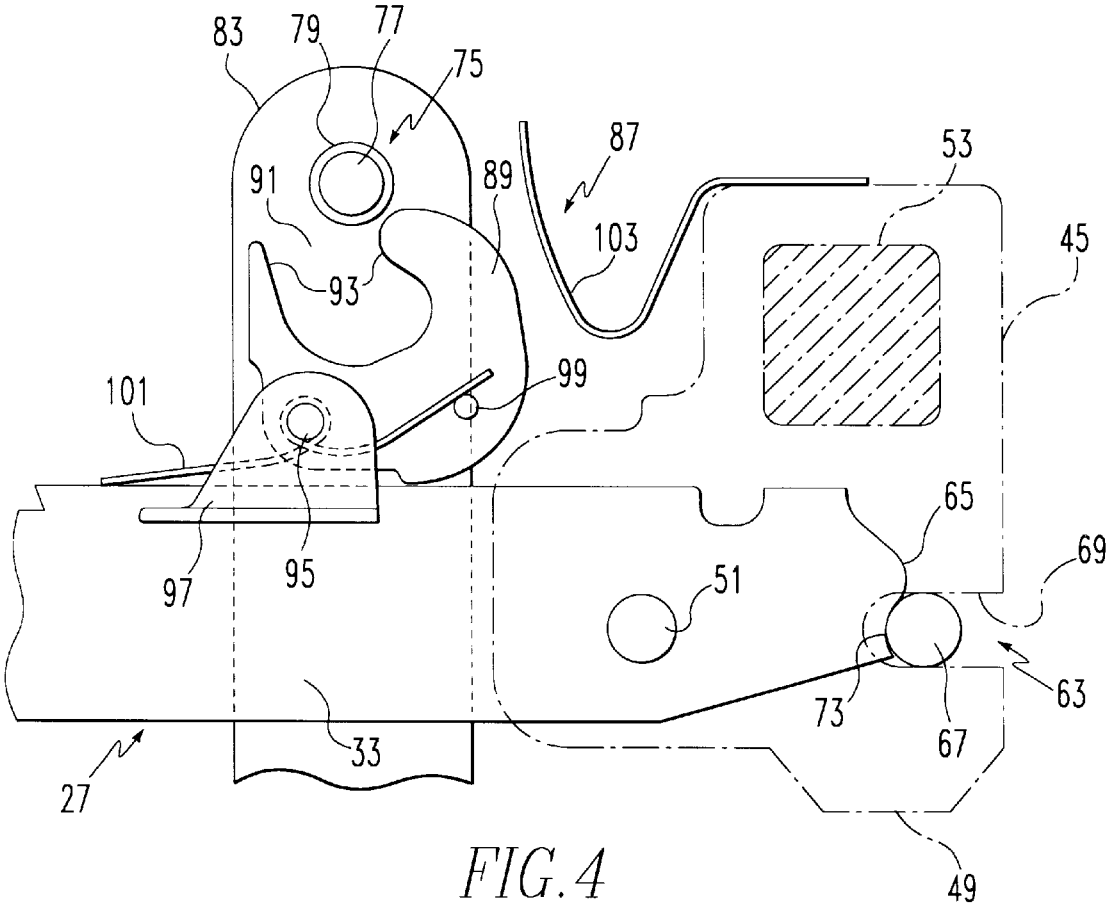
FIG. 4 is an enlarged view of a portion of FIG. 1 illustrating the condition of the latch in accordance with the invention shown with the circuit breaker in the open position.

As can be seen from FIG. 2, the carrier 45*b* of the contact support assembly 25*b* of the center pole instead of being molded of resin, is made of metal plates 46 which cantilever out from the cross-bar (into the plane of FIG. 3) and are pivotally connected to lower toggle links 57 of an operating mechanism shown schematically at 59. As is well known, the operating mechanism 59 can be manually or automatically (by a trip mechanism not shown) actuated to raise the lower toggle links 57 and rotate the carrier 45*b*. This also rotates the cross-bar 53 which is journalled in the housing 3 between the poles at 61 to simultaneously rotate the carriers 45*a* and 45*c* in the outer poles. As can be appreciated from FIG. 1, rotation of the carrier 45*a* in the clockwise direction rotates the contact arm 27 to open the separable contacts 9. The contact arm 27 is coupled to the carrier 45 by a cam assembly 63 so that it rotates with it. As best seen in FIG. 4, the cam assembly 63 includes cam surfaces 65 on the rear edges of the U-shaped bracket 33, and a cam roller pin 67 which is guided at its ends in slots 69 in the flanges 49 on the carriers 45. Referring to FIG. 3, the cam roller pin 67 is biased against the cam surface 65 by cam springs 71 connected to the pivot pin 51. The cam surfaces 65 have notches 73 in which the cam roller pin 67 is normally seated to couple the contact arm 27 to the carrier 45 for rotation therewith.

As is well known, the operating mechanism 59 requires time in order to respond to an overcurrent condition and open the contacts through rotation of the carriers 45. In the case of a short circuit, this allows the current to become very high by the time the contacts are separated. It can be very difficult to extinguish the resulting arc which is struck between the contacts, and in any event, this condition accelerates the wear on the contacts. It is common, therefore, to provide a blow open feature. This blow open feature is provided in the circuit breaker described in U.S. Pat. No. 4,887,057 by the flexible shunts 41 and the cam assembly 63. As will be noted in FIGS. 1 and 3, the flexible shunts 41 are bent in the middle so that the current flows in partially opposing directions in the two halves of the shunt. This generates very large magnetic repulsion forces in the case of very high overcurrents such as those associated with a short circuit. These forces generate a clockwise moment about the pin 31 sufficient to cam the cam roller pin 67 out of engagement with the notches 73 in the cam surfaces 65 through expansion of the cam springs 71. Once the cam roller pin 67 has disengaged from the notches 73, the contact arm 27 is free to rapidly rotate and open the separable contacts earlier than they could be opened by the operating mechanism 59. The blow open position of the contact arm 27 is shown in phantom in FIG. 1. Note that the carrier 45 has not yet begun to rotate.

As previously recognized, the kinetic energy generated by the rapid opening of the contact arm 27 can cause the contact arm to rebound from the blow open position and reclose thereby increasing the wear on the contacts. U.S. Pa. No. 4,887,057 addressed this problem by providing an energy absorber on a stop engaged by the contact arm at the blow open position. This stop 75 is in the form of a pin 77 extending transversely above the contact arm and supporting a rubber sleeve 79. The pin 77 is supported by a U-shaped bracket 81 having a first set of legs 83. The bracket 81 also has a second set of legs 85 which pivotally support the pivot pin 51 on which the carriers 45 are mounted.

Figure 5:
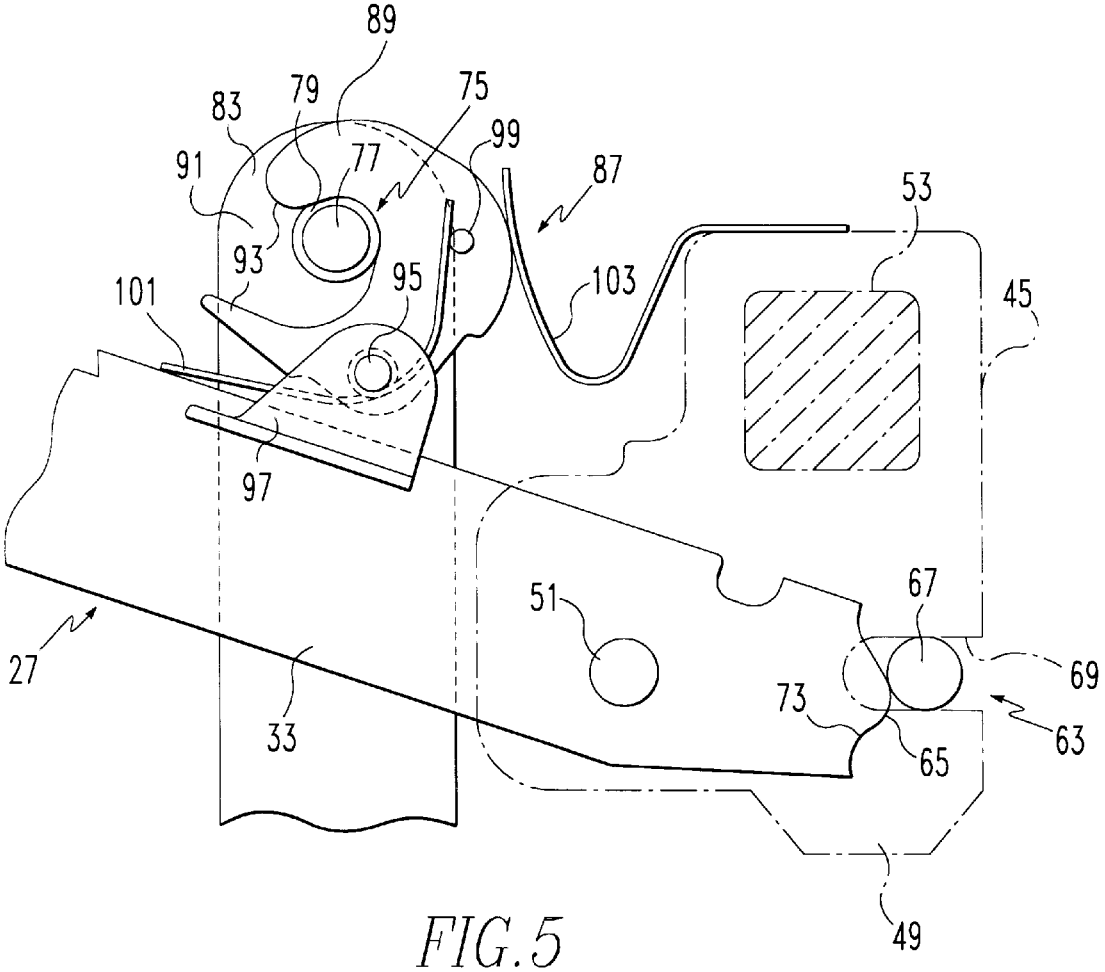
FIG. 5 is a view similar to FIG. 4 showing the circuit breaker in the blow open position with the latch engaged.

In an effort to further improve the described circuit breaker, a latching mechanism 87 is provided to mechanically retain the contact arm 27 in the blow open position. This latching mechanism 87 includes a latch hook 89 having an open slot 91 forming a pair of jaws 93. The latch hook 89 has a transverse pivot pin 95 which is rotatably supported in a U-shaped bracket 97 mounted on the top of the bracket 33 of the contact arm 27. As shown in FIG. 4, a torsion spring 101 which engages the top of the arm 27 and a projection 99 on the latch hook, biases the latch hook angularly to a cocked position in which the jaws 93 are aligned for engagement with the stop member 75. As the contact arm 27 is blown open and rotates relative to the carrier 45, the left jaw 93 of the latch hook 89 engages the stop member 75 and the latch hook 89 is rotated about the offset pivot pin 95 against the bias provided by the torsion spring 101 to the latched position shown in FIG. 5. A latch member in the form of a leaf spring 103 cantilevered from the carrier 45 holds the latch hook 89 against the bias provided by the torsion spring 101 to the latched position in which the jaws 93 mechanically engage the stop member 75 to prevent rebound of the contact arm 27 from the blow open position. The leaf spring 103 overrides the bias of the torsion 101 to retain the latch hook in the latched position.

Figure 6:
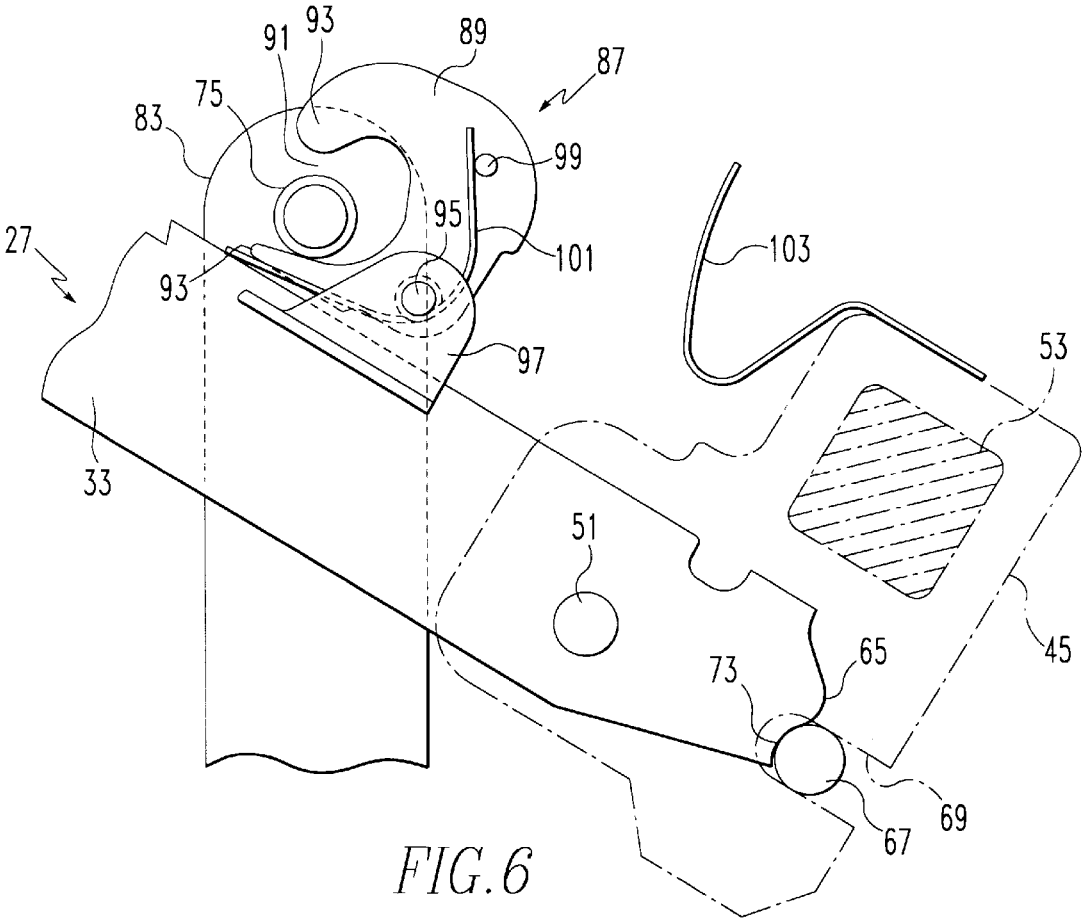
FIG. 6 is a view similar to Figure showing the circuit breaker in the open or tripped position.

When the operating mechanism 59 reacts to the overcurrent condition and rotates the carriers 45 through the crossbar 53, the cam roller pin 67 reengages the notches 73 in the cam surfaces 65 to recouple the contact arm 27 to the carrier 45 as shown in FIG. 6. As this occurs, the leaf spring 103 is disengaged from the latch hook 89. The torsion spring 101 can then rotate the latch hook toward the cocked position which releases the jaws from the stop member 75 as the operating mechanism is used to reclose the contacts by rotating the contact back to the position of FIG. 1. Thus, the contacts can be reclosed by the operating mechanism 59.

When the circuit breaker is manually opened or tripped opened by a current below that which blows the contact arm open, it can be appreciated that the latch hook remains in the cocked position so that it does not interfere with the operation of the circuit breaker. The latching mechanism 87 is only provided on the outer poles 7*a* and 7*c*. The center pole is provided with a resilient stop of the type described in U.S. Pat. No. 4,887,057, as positive interruption of current in the two phases switched by the outer poles is sufficient to terminate current flow in all three phases.

While specific embodiments of the invention have been described in detail, it will be appreciated by those skilled in the art that various modifications and alternatives to those details could be developed in light of the overall teachings of the disclosure. Accordingly, the particular arrangement disclosed are meant to be illustrative only and not limiting as to the scope of invention which is to be given the full breath of the claims appended and any and all equivalents thereof.

What is claimed is:

1. A circuit breaker comprising:

separable contacts comprising a fixed contact and a movable contact;

a movable contact support assembly including a movable contact arm having first and second ends and to which said movable contact is fixed adjacent said first end, and means pivotally supporting said movable contact arm adjacent said second end;

an operating mechanism operatively connected to said movable contact support assembly to rotate said movable contact support assembly between a closed position in which said separable contacts are closed to conduct current and an open position in which said separable contacts are open to interrupt current; said moveable contact arm being mounted by said moveable contact support assembly for rotation independently of said operating mechanism to a blow open position with said separable contacts open by magnetic repulsion forces generated by a predetermined overcurrent;

latch means releasably latching said movable contact arm in said blow open position to prevent rebound from said blow open position, said latch means comprising:

a latch hook pivotally mounted on said contact arm and having an open slot forming jaws;

a fixed stop member toward which said contact arm rotates to said blow open position;

means rotationally positioning said latch hook to a cocked position with said jaws aligned for engagement with said stop member, said latch hook rotating from said cocked position to a latched position in which said jaws engage said stop member as said contact arm reaches said blow open position to prevent rebound of said contact arm from said blow open position; and holding means holding said latch hook in said latched position until said operating mechanism responds to said predetermined overcurrent condition.

2. The circuit breaker of claim 1 wherein said means rotationally positioning said latch hook to said cocked position comprises biasing means and wherein said holding means comprises a latch member and means positioning said latch member to engage and hold said latch hook in said latched position as said contact arm rotates to said blow open position and which repositions said latch member to disengage from said latch hook as said operating mechanism responds to said predetermined overcurrent and rotates said moveable contact support assembly to said open position.

3. The circuit breaker of claim 2 wherein said latch member is a leaf spring.

4. The circuit breaker of claim 2 wherein said latch hook has a transverse pivot member supporting said latch hook for rotation and said biasing means comprises a torsion spring mounted on said pivot member and having a first arm bearing against said moveable contact arm and a second arm engaging said latch hook.

5. The circuit breaker of claim 4 wherein said latch member is a leaf spring.

6. The circuit breaker of claim 1 wherein said means pivotally supporting said moveable contact arm comprises a contact arm carrier, means pivotally mounting the moveable contact arm on said contact arm carrier, and means rotating said contact arm carrier by said operating mechanism between said open and closed positions, said holding means being carried by said contact arm carrier.

7. The circuit breaker of claim 6 wherein said holding means comprises a leaf spring.

8. The circuit breaker of claim 6 wherein said contact arm carrier includes a crossbar and said holding means is mounted on said crossbar.

9. The circuit breaker of claim 8 wherein said holding means comprises a leaf spring.

10. The circuit breaker of claim 9 wherein said means rotating said latch hook to said cocked position comprises a spring which biases said latch hook to said cocked position, said leaf spring overriding said bias to hold said latch hook in the latched position.

11. The circuit breaker of claim 10 wherein said circuit breaker is a three-phase circuit breaker having a set of separable contacts for each phase, separate moveable contact support assemblies for each set of separable contacts mounted side-by-side, a single operating mechanism operatively connected to one of said moveable contact support assemblies, and wherein said crossbar connects the other moveable contact support assemblies to said one moveable contact support assembly for simultaneous movement by said operating mechanism, said latch means only being provided for said other moveable contact support assemblies.

12. A latch mechanism for a circuit breaker having a contact arm pivotally mounted on a contact arm carrier for blow open toward a blow open stop in response to a predetermined overcurrent, said latch mechanism comprising:

a latch hook pivotally mounted on said contact arm and having an open slot forming jaws;

means rotationally positioning said latch hook to a cocked position with said jaws aligned for engagement with said stop member, said latch hook rotating from said cocked position to a latched position in which said jaws engage said stop member as said contact arm blows open to prevent rebound of said contact arm; and holding means holding said latch hook in said latched position until said operating mechanism responds to said predetermined overcurrent.

13. The latch mechanism of claim 12 wherein said means rotationally positioning said latch hook to said cocked position comprises a first spring and wherein said holding means comprises a latch member mounted on said contact arm carrier which engages and rotates said latch hook to said latched position as said contact arm blows open and which disengages from the latch hook as the circuit breaker responds to the predetermined overcurrent and the contact arm carrier rotates to an open position.

14. The latch mechanism of claim 13 wherein said latch member is a leaf spring.

15. The latch mechanism of claim 14 wherein said latch hook has a transverse pivot member supporting said latch hook for rotation and said first spring comprises a torsion spring mounted on the pivot member and bearing against said moveable contact arm and said latch hook.

* * * * *